US012716612B2

(12) United States Patent
Schröder et al.

(10) Patent No.: US 12,716,612 B2
(45) Date of Patent: Aug. 25, 2026

(54) CLOSURE UNIT FOR A VENTILATION DEVICE

(71) Applicant: Viessmann Climate Solutions SE, Allendorf (DE)

(72) Inventors: Daniel Schröder, Olsberg (DE); Rico Eitzenhöfer, Bromskirchen (DE)

(73) Assignee: VIESSMANN CLIMATE SOLUTIONS SE, Allendorf (DE)

( * ) Notice: Subject to any disclaimer, the term of this patent is extended or adjusted under 35 U.S.C. 154(b) by 468 days.

(21) Appl. No.: 18/031,685

(22) PCT Filed: Oct. 14, 2021

(86) PCT No.: PCT/EP2021/078504

§ 371 (c)(1),
(2) Date: Apr. 13, 2023

(87) PCT Pub. No.: WO2022/084156

PCT Pub. Date: Apr. 28, 2022

(65) Prior Publication Data

US 2023/0383985 A1 Nov. 30, 2023

(30) Foreign Application Priority Data

Oct. 21, 2020 (EP) ..... 20203051

(51) Int. Cl.
*F24F 13/14* (2006.01)
*F24F 12/00* (2006.01)

(52) U.S. Cl.
CPC ..... *F24F 13/1426* (2013.01); *F24F 12/006* (2013.01); *F24F 2012/007* (2013.01)

(58) Field of Classification Search
CPC ..... F24F 13/1426; F24F 13/10; F24F 12/006; F24F 2012/007; Y02B 30/56
See application file for complete search history.

(56) References Cited

U.S. PATENT DOCUMENTS

2007/0158049 A1 7/2007 Kim et al.

FOREIGN PATENT DOCUMENTS

| | | | | |
|---|---|---|---|---|
| DE | 3524209 A1 * | 1/1987 | ..... | F24F 3/1411 |
| DE | 2807901 C2 * | 4/1994 | ..... | F24F 11/74 |
| DE | 20 2012 010 671 U1 | 12/2012 | | |
| DE | 10 2011 114 885 A1 | 4/2013 | | |
| DE | 10 2013 216 306 A1 | 2/2015 | | |
| EA | 1 962 031 A2 | 8/2008 | | |
| EP | 0 044 560 B1 | 5/1984 | | |
| EP | 1 132 690 B1 | 7/2004 | | |

(Continued)

OTHER PUBLICATIONS

English translation of DE-2807901A (Year: 1994).*

(Continued)

*Primary Examiner* — Tho V Duong
(74) *Attorney, Agent, or Firm* — Sughrue Mion, PLLC

(57) ABSTRACT

A closure unit for a ventilation device having at least two pivotally arranged flaps for closing a respective ventilation channel. The two flaps can be moved by a common shaft which defines a pivot axis. The two flaps are thus positively coupled and can be actuated simultaneously by a single motor. The closure unit allows the use of two heat exchangers operated in parallel without an additional bypass channel.

8 Claims, 8 Drawing Sheets

(56) References Cited

FOREIGN PATENT DOCUMENTS

| | | | | | |
|---|---|---|---|---|---|
| EP | 1321649 | B1 | * | 2/2006 | ..... F02D 11/10 |
| EP | 2 498 014 | B1 | | 5/2015 | |
| EP | 3 260 793 | A1 | | 12/2017 | |
| FR | 2809166 | A1 | * | 11/2001 | ..... B60H 1/00671 |
| GB | 2160968 | A | * | 1/1986 | ..... F24F 3/1411 |
| KR | 10-1263656 | B1 | | 5/2013 | |
| WO | 97/06390 | A1 | | 2/1997 | |
| WO | WO-2016105221 | A1 | * | 6/2016 | ..... F24F 13/20 |

OTHER PUBLICATIONS

English translation of EP 1321649A1 (Year: 2006).*
International Search Report of PCT/EP2021/078504 dated Mar. 24, 2022 [PCT/ISA/210].

* cited by examiner

CLOSURE UNIT FOR A VENTILATION DEVICE

CROSS REFERENCE TO RELATED APPLICATIONS

This application is a National Stage of International Application No. PCT/EP2021/078504 filed on Oct. 14, 2021, claiming priority based on European Patent Application No. 20203051.6 filed on Oct. 21, 2020.

TECHNICAL FIELD

The present invention relates to a closure unit of a ventilation apparatus, in particular a ventilation apparatus with heat recovery, to a ventilation apparatus, and to a method for operating a ventilation apparatus of a building.

PRIOR ART

Buildings are increasingly being equipped with ventilation apparatuses with heat recovery. For this purpose, the outside air introduced from the outside into the building and the exhaust air guided from the interior of the building to the outside are guided through a common heat exchanger. In this way, heat is transferred from one air volume stream to the other.

According to the time of year and prevailing temperatures, however, this exchange of heat is not desired or at least is not desired to a constant extent. Provision is therefore made of bypass channels in order for one of the two air volume streams to be directed to the inside or to the outside without passing through the heat exchanger. The passage through the heat exchanger is in this case closed by a closure apparatus. Said closure apparatus is normally a flap or a roller screen.

DE 10 2013 216 306 A1 uses a first flap in the bypass channel and a second flap in the supply-air channel. The two flaps are actuated separately from one another.

EP 0 044 560 B1, too, discloses a ventilation apparatus having a heat exchanger and a bypass, wherein the apparatus has individually actuated flaps.

EP 1 132 690 B1 presents two heat exchangers connected in series, two bypass channels and multiple individually actuated flaps.

EP 2 498 014 B1 discloses a heat-recovery module having a roller screen, which, in the rolled-up state, blocks the bypass and opens up the heat exchanger and, in the unrolled state, opens up the bypass but blocks the heat exchanger.

EP 1 962 031 A2 presents a heat-recovery module having a flap and having a slide, which form a structural unit. The adjustment movements thereof are forcibly coupled, which is achieved by connection of the mutually perpendicularly oriented parts. This structural unit directly adjoins the heat exchanger/bypass apparatus without further lines or channels.

Furthermore, heat exchangers connected in parallel are known. US 2007/0158049 A1, for example, discloses a ventilation unit of said type having multiple heat exchangers which are arranged one next to the other and which are connected in parallel and correspondingly flowed through in a parallel manner. A common bypass channel is arranged next to the heat exchangers.

DE 10 2011 114 885 A1 describes a heat-exchanger arrangement with a gaseous and a liquid fluid. The arrangement has two heat exchangers which are impinged on in parallel and which are arranged one behind the other in a spatially offset manner. Two bypass channels allow air to be supplied to and removed from the heat exchangers. Each bypass channel has its own separately actuated closure flap.

As before, the known apparatuses have a relatively large space requirement. The use of multiple heat exchangers has the disadvantage that more bypass channels and flaps are required, which increases the space requirement and the manufacturing costs, in particular because of the increased number of motors for actuating the flaps.

SUMMARY OF THE INVENTION

It is therefore an object of the invention to design ventilation apparatuses, in particular of a ventilation system of a building, in as inexpensive and space-saving a manner as possible.

The closure unit according to the invention of a ventilation apparatus has at least two pivotably arranged flaps for closing off in each case one ventilation channel. The two flaps are movable by means of a common shaft which defines a common pivot axis. The two flaps are thus forcibly coupled and can be simultaneously actuated by means of a single motor.

This closure unit is suitable for a wide variety of applications in ventilation apparatuses in which two ventilation channels have to be simultaneously closed or opened. In this case, one ventilation channel can be opened and the other one can be closed according to the position of the flaps. Preferably, however, both ventilation channels are simultaneously closed or opened.

This closure unit serves for example as a double bypass flap with a single motor. This closure unit, however, is preferably used in a ventilation apparatus which, without a separate bypass channel, still has a bypass function. This will be explained in more detail later in the text.

This closure unit is suitable in particular for use in ventilation apparatuses with heat recovery, in particular by means of heat exchangers. Preferably, provision is made of two or more heat exchangers which are preferably operated in parallel. This will be explained in more detail further below in the text.

Preferably, the pivot axis of the closure unit according to the invention extends centrally through the two flaps.

The shaft may be actuated manually. Preferably, however, it is driven by means of a motor. Preferably the motor, in the longitudinal direction of the shaft, is arranged above or below the two flaps or centrally between the two flaps. Since just a single motor has to be used, the production costs can be reduced. The arrangement above or below the flaps reduces the space requirement, in particular if a motor designed to be as flat as possible is used. This arrangement moreover allows optimum accessibility of the motor in a ventilation apparatus, which considerably facilitates maintenance.

Preferably, the two flaps are arranged at an angle of 90° to one another. If the two ventilation channels extend parallel to one another, in the case of this 90° arrangement of the flaps, a first channel is closed by the first flap, while the second channel is opened by the second flap. If the ventilation channels are arranged at an angle of 90° to one another, then, in the case of a 90° arrangement of the flaps, the channels are closed or opened up together. This arrangement of the flaps consequently allows use in differently arranged channels. The same applies if the flaps are arranged parallel to one another, albeit with a reversed effect in terms of their closing behavior.

In a preferred embodiment, each of the two flaps forms a closure surface, wherein the two closure surfaces contain the pivot axis of the shaft. This arrangement facilitates inexpensive manufacture and requires relatively little space.

Preferably, the two flaps have a rectangular cross section. Other shapes, in particular round shapes, are likewise possible. The shape of the flap is preferably adapted in each case to the shape of the channels to be closed off.

In a preferred embodiment, the closure unit has a first housing for pivotably receiving a first flap and has a second housing for pivotably receiving a second flap. The shaft has an upper portion which is pivotably mounted in the first housing and which is connected at a first end to the first flap and at a second end to the motor. The shaft moreover has a lower portion which is connected at a first end to the first flap and at a second end to the second flap. The second flap and/or the second end of the lower portion of the shaft are/is pivotably mounted in the second housing.

In this way, the closure unit can be designed as a relatively simply constructed and robust module which can, as a structural unit, be inserted into a ventilation apparatus and, according to requirement, also be exchanged in a simple manner during servicing work.

This closure unit can be used in a wide variety of application areas of ventilation apparatuses. Preferably, however, it is used in the ventilation apparatus according to the invention described in the following text.

A ventilation apparatus according to the invention for a building has:

- at least one first and one second heat exchanger, which are operated in parallel,
- an outside-air channel for feeding outside air from the outside into the two heat exchangers,
- a supply-air channel for discharging the outside air, now referred to as supply air, from the heat exchangers into an interior space of the building,
- an exhaust-air channel for feeding exhaust air from the interior space of the building into the two heat exchangers, and
- an expulsion-air channel for discharging the exhaust air, now referred to as expulsion air, from the heat exchangers to the outside.

Furthermore, provision is made of a closure unit which selectively

- opens up all the channels or

- allows an air volume stream of the outside air through one of the two heat exchangers and simultaneously prevents an air volume stream of the exhaust air through this one of the two heat exchangers and
- simultaneously allows the air volume stream of the exhaust air through the other one of the two heat exchangers and prevents the air volume stream of the outside air through this other one of the two heat exchangers.

This ventilation apparatus can be designed to be extremely compact and flat. The ventilation apparatus nevertheless allows a large volume stream.

It serves for use in a ventilation system of a building, in particular in a central ventilation system of a building, preferably a residential or office building.

It is particularly advantageous that the ventilation apparatus according to the invention does not require an additional bypass channel. The two heat exchangers form bypass channels themselves, specifically if they are flowed through only by one of the two air volume streams and in this way no exchange of heat with the other air volume stream can take place.

The closure unit used in the ventilation apparatus according to the invention may consist of two individually actuated or of jointly actuated, in particular forcibly coupled, closure bodies. Preferably, the above-described closure unit according to the invention is used.

In a preferred embodiment of the ventilation apparatus, the closure unit is designed in such a way that it selectively only partially allows or prevents the air volume streams in that it only partially opens up or only partially closes off the channels or sub-channels.

In preferred embodiments, this arrangement consequently allows the air volume streams to be guided through the two heat exchangers with different portions. For example, it is possible for ⅔ of the outside air to be guided through the first heat exchanger and ⅓ thereof to be guided through the second heat exchanger, wherein, in this case, ⅓ of the exhaust air is directed through the first heat exchanger and ⅔ thereof is directed through the second heat exchanger.

Preferably, the closure unit of the ventilation apparatus according to the invention has two closure bodies which are actuatable together by means of a common motor. The closure bodies may be flaps as in the apparatus according to the invention. They may also be differently arranged flaps or different types of closure bodies.

In a preferred embodiment of the ventilation apparatus, the channels are divided into sub-channels. That is to say, the outside-air channel is divided into a first outside-air sub-channel and a second outside-air sub-channel, wherein the first outside-air sub-channel leads into the first heat exchanger and the second outside-air sub-channel leads into the second heat exchanger. The supply-air channel is divided into a first supply-air sub-channel and a second supply-air sub-channel, wherein the first supply-air sub-channel leads out of the first heat exchanger and the second supply-air sub-channel leads out of the second heat exchanger. The exhaust-air channel is divided into a first exhaust-air sub-channel and a second exhaust-air sub-channel, wherein the first exhaust-air sub-channel leads into the first heat exchanger and the second exhaust-air sub-channel leads into the second heat exchanger. The expulsion-air channel is divided into a first expulsion-air sub-channel and a second expulsion-air sub-channel, wherein the first expulsion-air sub-channel leads out of the first heat exchanger and the second expulsion-air sub-channel leads out of the second heat exchanger.

Preferably, those sub-channels which are opened up or closed off by means of the closure unit extend offset at an angle of 90° with respect to one another in the region of the closure unit. Preferably, it is also the case that the flaps are arranged offset at an angle of 90° with respect to one another, wherein in each case one flap is arranged in a sub-channel.

The sub-channels all have, according to embodiment, the the same cross-sectional area and preferably even the same cross-sectional shape. In preferred embodiments, a first sub-channel has, at least in the region of the closure device, a smaller cross section than an associated second sub-channel. Preferably, that sub-channel which is arranged in front of the heat exchanger in the flow direction is of relatively large form, so that the sub-channel which follows after the heat exchanger in the flow direction is relatively small. In this way, an optimized flow behavior is achieved. The throughflow is improved and a uniform distribution in front of the heat exchanger and higher efficiency are obtained. In preferred embodiments, the width of the sub-channels is equal but the height thereof is different.

Preferably, at least one fan is provided. Preferably, two fans are provided; one for the outside air or supply air, and one for the exhaust air or expulsion air.

According to embodiment, the closure unit simultaneously closes off the first supply-air sub-channel and the second exhaust-air sub-channel or opens them up, or the closure unit simultaneously closes off the first outside-air sub-channel and the second expulsion-air sub-channel or opens them up.

In a method according to the invention for operating the stated ventilation apparatus according to the invention, at least the first and second heat exchangers are operated in parallel, the outside-air channel feeds the outside air from the outside to the two heat exchangers, the supply-air channel discharges the outside air from the heat exchangers into the interior space of the building, the exhaust-air channel feeds the exhaust air from the interior space of the building to the two heat exchangers, and the expulsion-air channel discharges the exhaust air from the heat exchangers to the outside.

The closure unit selectively opens up all the channels or allows an air volume stream of the outside air through one of the two heat exchangers and simultaneously prevents an air volume stream of the exhaust air through this one of the two heat exchangers, wherein said closure unit simultaneously allows the air volume stream of the exhaust air through the other one of the two heat exchangers and prevents the air volume stream of the outside air through this other one of the two heat exchangers.

This eliminates the need for a separate bypass channel. A simple closure unit, for example having two jointly actuatable, preferably forcibly coupled, flaps is sufficient to prevent an exchange of heat between the two air volume streams.

Further embodiments are laid down in the dependent claims.

BRIEF DESCRIPTION OF THE DRAWINGS

A preferred embodiment of the invention is described in the following with reference to the drawings, which are for the purpose of illustrating the present preferred embodiment of the invention and not for the purpose of limiting the same. In the drawings.

DESCRIPTION OF PREFERRED EMBODIMENTS

Figure 2:
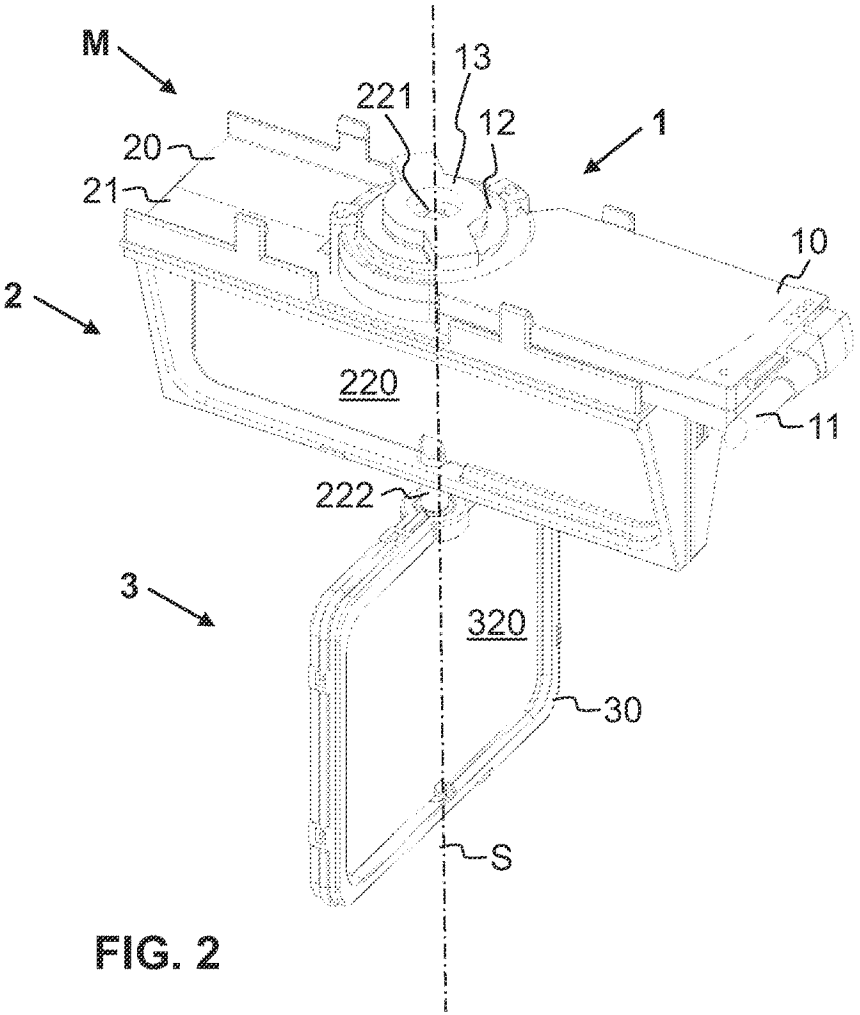
FIG. 2 shows a perspective illustration of a closure unit according to the invention.
Figure 1:
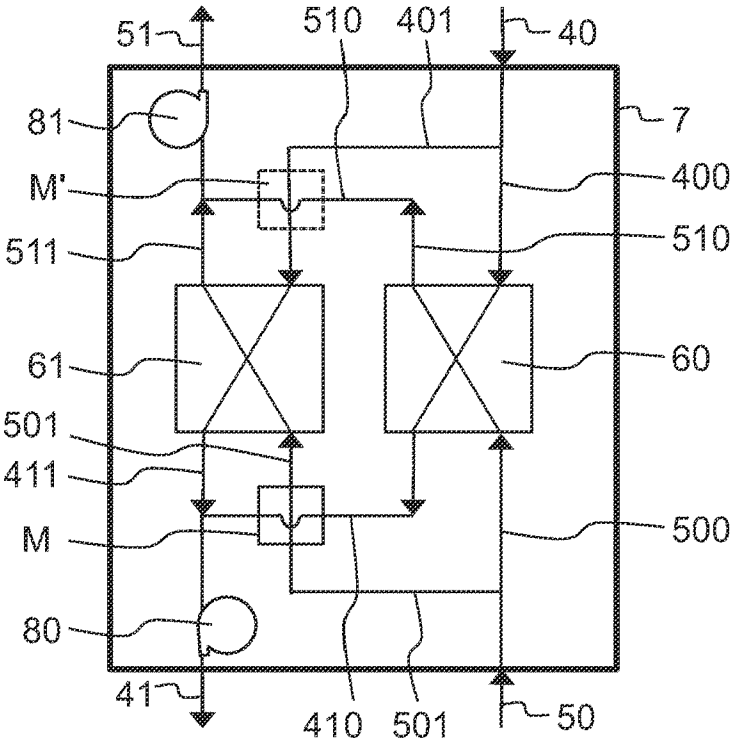
FIG. 1 shows a schematic illustration of a ventilation apparatus according to the invention.
Figure 4:
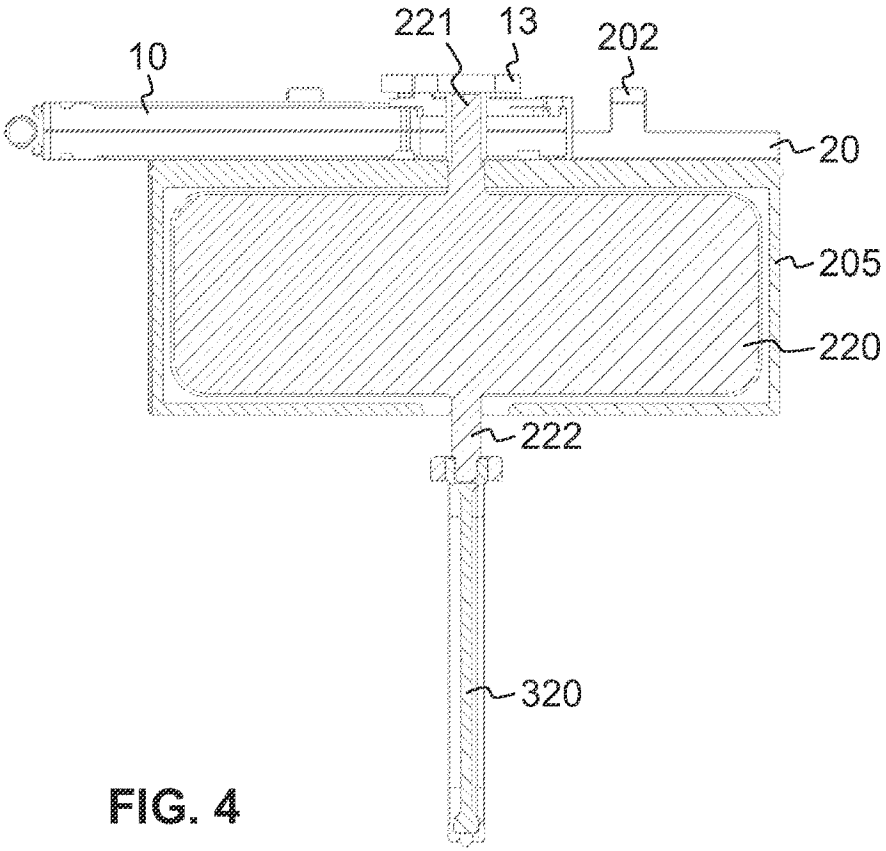
FIG. 4 shows a cross section through a closure unit as per FIG. 3.
Figure 3:
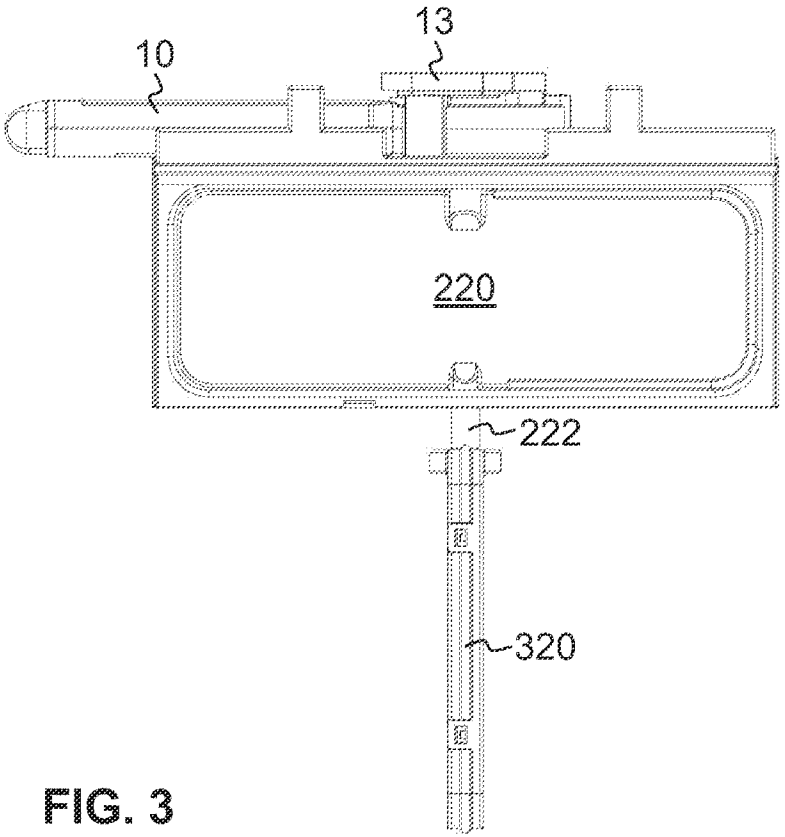
FIG. 3 shows a first view of the closure unit as per FIG. 2.
Figure 6:
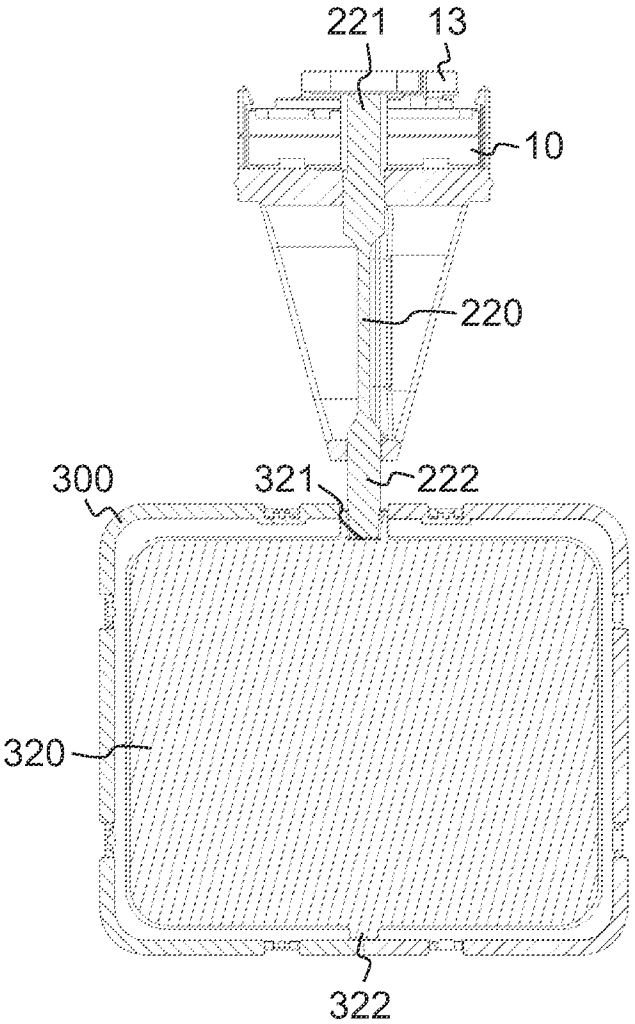
FIG. 6 shows a cross section through a closure unit as per FIG. 5.
Figure 5:
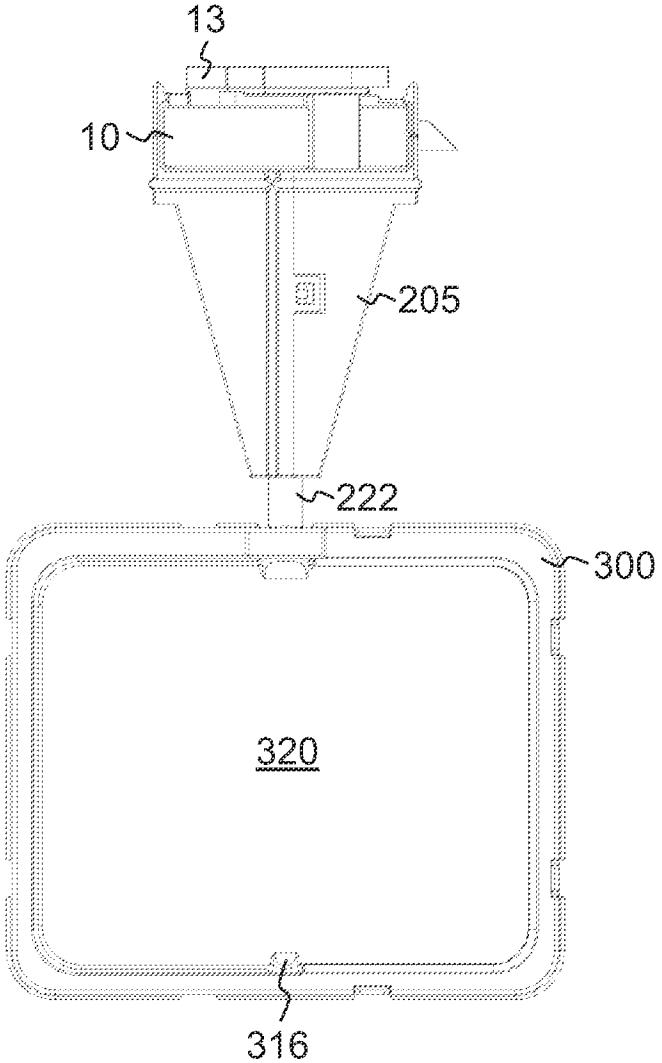
FIG. 5 shows a second view of the closure unit as per FIG. 2.

FIG. 1 shows a schematic view of a ventilation apparatus according to the invention for use in a ventilation system of a building, in particular in a central ventilation system.

The ventilation apparatus has a closed housing 7 which is designed to be as flat as possible. Two heat exchangers 60, 61 are arranged in the housing 7. They are preferably arranged one next to the other and operated in parallel. The heat exchangers 60, 61 are preferably plate heat exchangers of a known type or differently designed heat exchangers of a known type that are as flat as possible.

Leading into the housing 7 is an outside-air channel 40 for feeding outside air into the two heat exchangers 60, 61, a supply-air channel 41 for discharging into an interior space of the building the outside air which has flowed through the heat exchangers 60, 61, an exhaust-air channel 50 for introducing exhaust air from the interior space of the building into the two heat exchangers 60, 61, and an expulsion-air channel 51 for discharging to the outside the exhaust air which has flowed through the heat exchangers 60, 61.

The exhaust air discharged to the outside is referred to as expulsion air, and the outside air directed into the interior space is referred to as supply air. If the two air volume streams of the outside air and the exhaust air simultaneously flow through both heat exchangers 60, 61, then a transfer of heat takes place in a known manner, said transfer of heat serving for heat recovery in winter and possibly also for cooling in summer. According to the time of year or temperature conditions, an exchange of heat is not desired or is desired only to a reduced extent.

Provision is preferably made of at least one, preferably multiple fans 80, 81. In the present example, a first fan 80 is situated in the supply-air channel 41 and a second fan 81 is situated in the expulsion-air channel 51. In other embodiments, the first fan 80 is arranged in the expulsion-air channel 41 and a second fan 81 is arranged in the supply-air channel 51. The fans 80, 81 are preferably operated by means of closed-loop control, preferably according to a program.

In order for the two heat exchangers 60, 61 to be able to be flowed through in parallel operation, the stated channels 40, 41, 50, 51 are divided into corresponding sub-channels. Consequently, provision is made of a first and second outside-air sub-channel 400, 401, a first and second supply-air sub-channel 410, 411, a first and second exhaust-air sub-channel 500 501, and a first and second expulsion-air sub-channel 510, 511. The first sub-channels 400, 410, 500, 510 are connected to the first heat exchanger 60, and the second sub-channels 401, 411, 501, 511 are connected to the second heat exchanger 61.

According to the invention, provision is made of a closure unit M which closes off two of the sub-channels together. The closure unit M has two closure bodies, wherein in each case one of the closure bodies closes off one of the two sub-channels. Preferably, the two closure bodies are flaps. Preferably, the closure bodies are motor-operated and are actuatable via a controller.

In a very simple embodiment, the two closure bodies are arranged spatially separated from one another and are actuated simultaneously or in succession by means of the controller.

In preferred embodiments, however, the two closure bodies are arranged adjacent to one another. The two sub-channels to be closed off extend for this purpose in the region of the closure unit M (also referred to as closure module or module), and consequently adjacent to one another in the region of the closure bodies, in order for them to be able to be simultaneously closed and reopened together. The two sub-channels may extend parallel to one another. Preferably they cross, however, wherein they preferably extend one above the other for this purpose. In FIG. 1, the first supply-air sub-channel 410 and the second exhaust-air sub-channel 501 are involved. If these two sub-channels are open, then both the outside-air volume stream and the exhaust-air volume stream run through both heat exchangers 60, 61. The two heat exchangers 60, 61 are consequently flowed through in parallel by both air volume streams.

If the two sub-channels 410 and 501 are closed, then the outside-air volume stream can flow only through the second heat exchanger 61 and the exhaust-air volume stream can flow only through the first heat exchanger 60. The streams are thus "bypassed", that is to say guided past one another, without a separate bypass channel having to be present for this purpose. No transfer of heat between the two air volume flows takes place.

Alternatively, the closure unit can also be arranged on the other side of the heat exchangers 60, 61. This is illustrated in FIG. 1 by a dashed-line rectangle provided with the reference sign M'. In this variant, the second outside-air sub-channel 401 and the first expulsion-air sub-channel 510 are arranged at an angle of 90° to one another and one above the other so that they can be closed off together. In this way, in the case of the closed position of the closure unit M', the outside-air volume stream is guided exclusively through the first heat exchanger 60 and the exhaust-air volume stream is guided exclusively through the second heat exchanger 61. In this case, too, no additional bypass channel is necessary.

The closure unit M may also close off other combinations of first and second sub-channels, as is readily evident to a person skilled in the art.

FIGS. 2 to 12 illustrate a closure unit M according to the invention, which is preferably able to be use in the ventilation apparatus according to the invention described. This closure unit M can however also be used in other ventilation apparatuses in which two channels arranged one above the other or one next to the other are to be closed together and simultaneously.

If the air channels are arranged one above the other, then the channels cross at an angle of 90°. If they are arranged one next to the other, then they extend in a parallel manner. In both cases, a pivot axis of the closure unit extends at an angle of 90° in relation to the longitudinal directions of the air channels. The pivot axis extends vertically in the case of air channels arranged one above the other and horizontally in the case of air channels arranged one next to the other.

As can be clearly seen in FIGS. 2 to 6, the closure unit according to the invention comprises a first motor unit 1, a first flap device 2 and a second flap device 3. It is preferably designed as a structural unit in the form of a module which is able to be fitted in its entirety into the ventilation apparatus. In other embodiments, the parts are fitted individually or as sub-modules.

The motor unit 1 has a motor 10 which is designed to be as flat as possible. It is held fixed on a frame 20, 21 of the first flap device 2. A power cable 11 leads to a controller (not illustrated) of the ventilation apparatus. The motor unit 1 furthermore has a rotary plate 12 which is able to be pivoted by means of the motor 10. It is also able to be actuated by hand. In the present example, a component 13 with a magnet is provided for this purpose.

The apparatus has a multi-piece shaft 221, 222, 223 which defines a pivot axis S. An upper shaft portion 221 is held fixed in the rotary plate 12 and is pivotable or rotatable therewith. The upper shaft portion 221 is connected to a pivotable or rotatable first flap 220 of the first flap device 2. In the present example, it is formed in one piece on the first flap 220. A lower shaft portion 222 extends from the first flap 220 downward along the pivot axis S. This portion 222, too, is preferably formed in one piece on the first flap 220. Said portion is connected to a second flap 320 of the second flap device 3. Preferably, it is releasably connected thereto.

As can be clearly seen in FIGS. 2 to 6, the pivot axis S extends within the surfaces of the two flaps 220, 320. It preferably extends centrally. The two flaps 220, 320 are arranged at an angle of 90° to one another. They are formed according to the shape of the sub-channels which receive them. In the present example, the air sub-channels have a rectangular cross section and the flaps 220, 320 are of correspondingly rectangular form. They may be of the same size and have the same shape. Preferably, the channel behind the heat exchanger in the flow direction, here the upper channel, is however of narrower form for flow-related reasons, so that the first flap 220 is of narrower and longer form than the second flap 320.

If the flaps 220, 320 are rotated by means of the motor-operated shaft 221, 222, then they pivot together, wherein they both simultaneously open up or close off their sub-channels. Intermediate positions are likewise possible, wherein said flaps open up or close off their sub-channels, in each case in the same ratio.

The two flaps 220, 320 are preferably held in frames 20, 21, 30, 31. In this way, the unit M can, as an intermediate piece, be arranged between two portions of the air sub-channels and be connected thereto. This facilitates the assembly of the ventilation apparatus, in particular if this itself is likewise designed as a structural unit, that is to say as a module.

Figure 7:
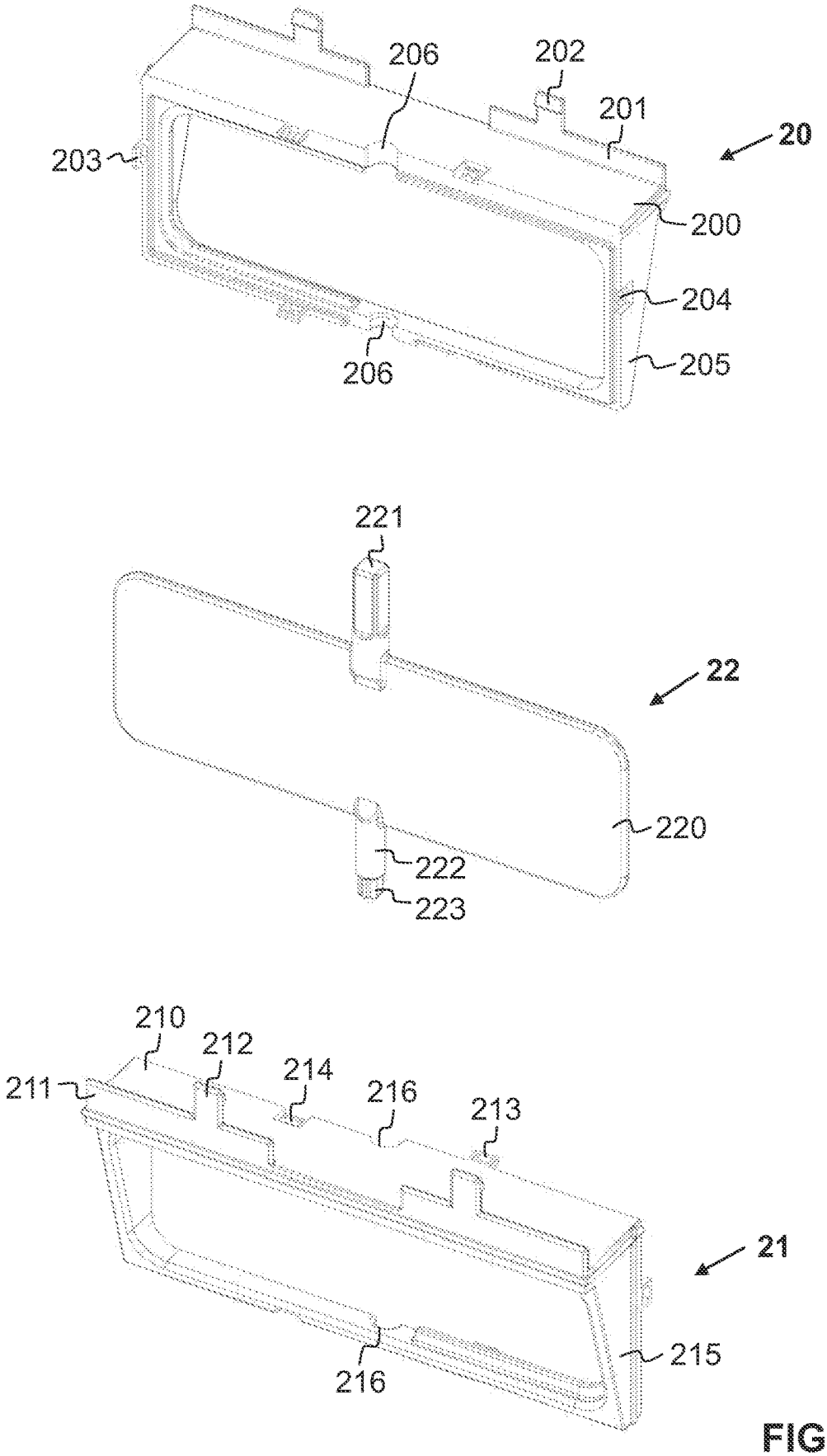
FIG. 7 shows an exploded illustration of a first flap device of the closure unit as per FIG. 2.
Figure 9:
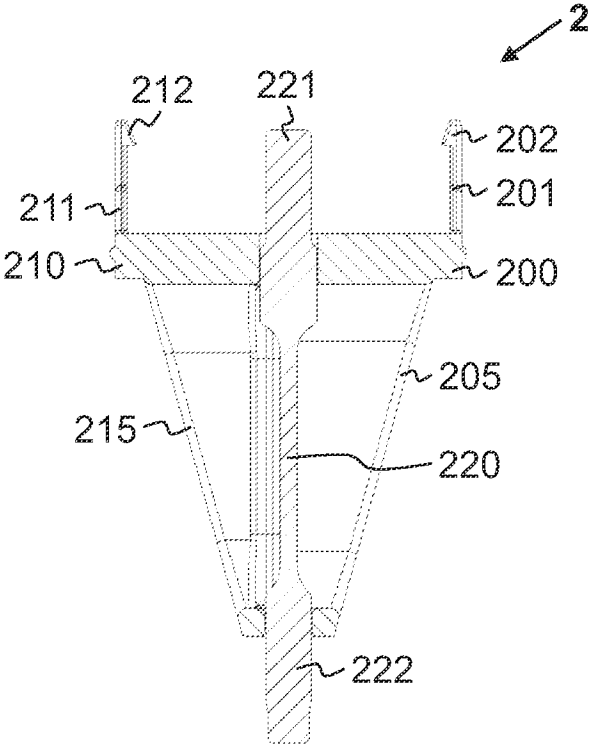
FIG. 9 shows a longitudinal section through the upper part as per FIG. 7.
Figure 8:
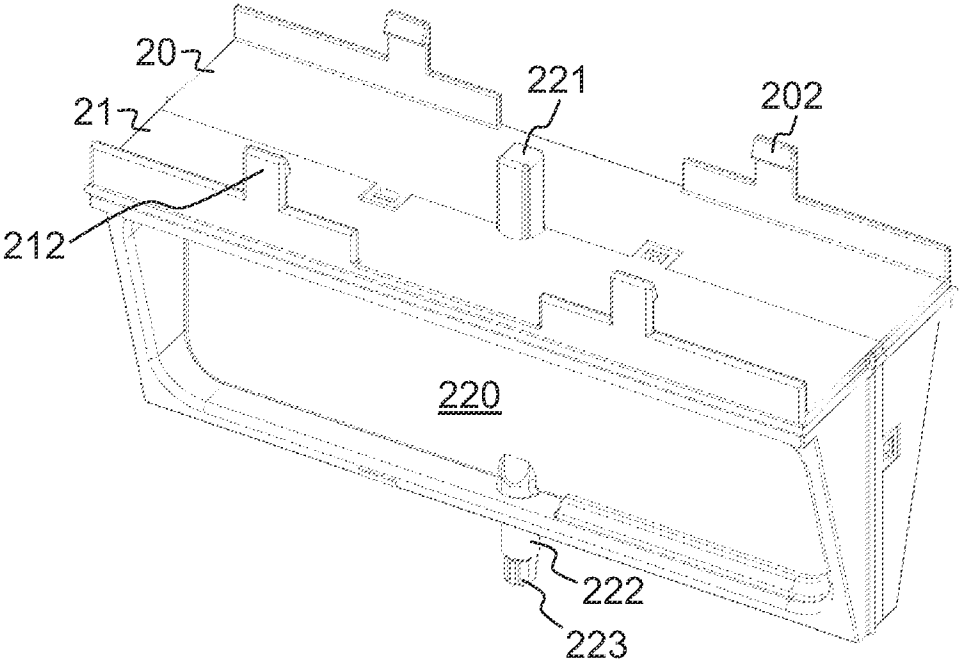
FIG. 8 shows a perspective view of the upper part as per FIG. 7.
Figure 10:
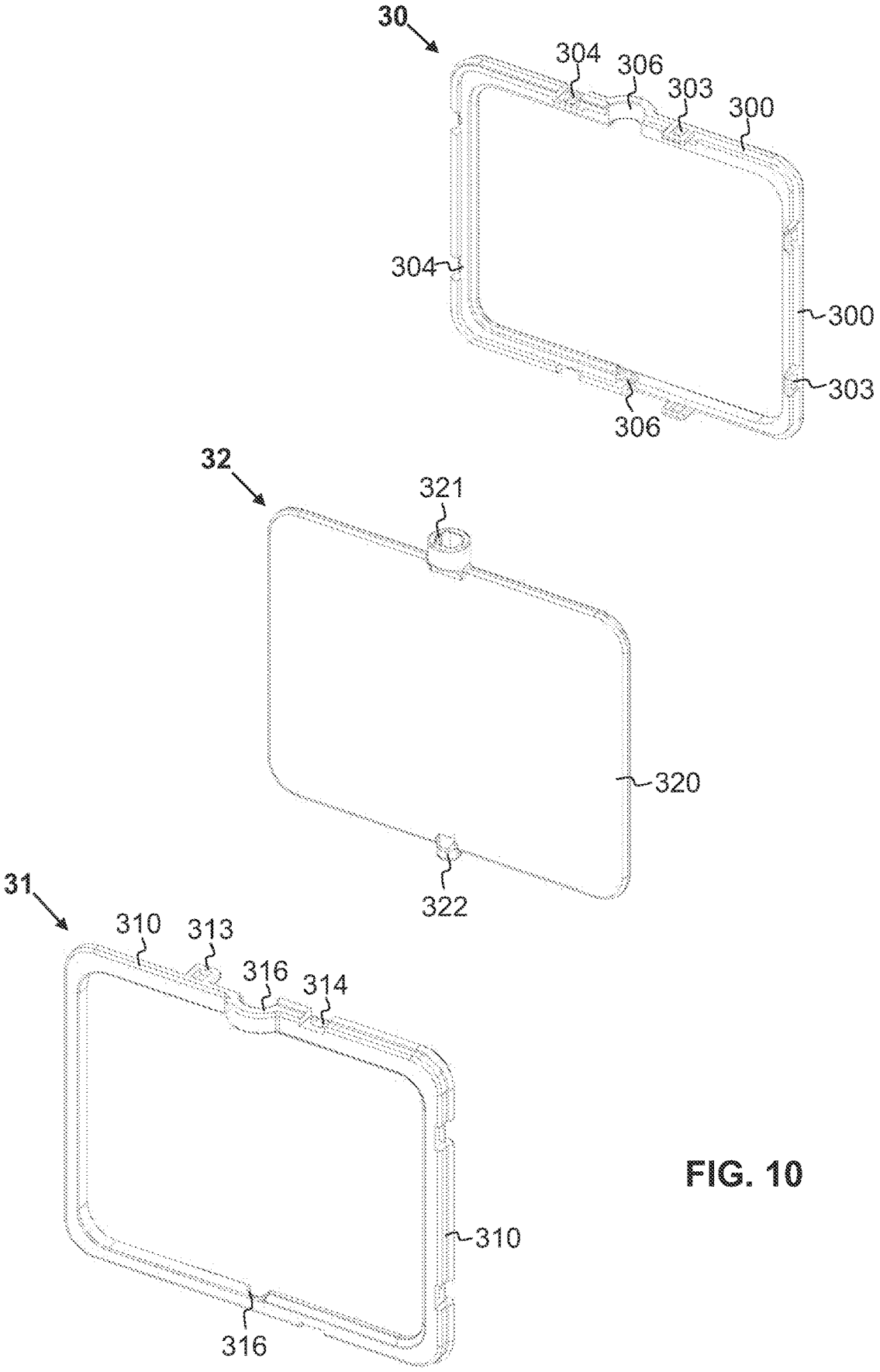
FIG. 10 shows an exploded illustration of a second flap device of the closure unit as per FIG. 2.
Figure 12:
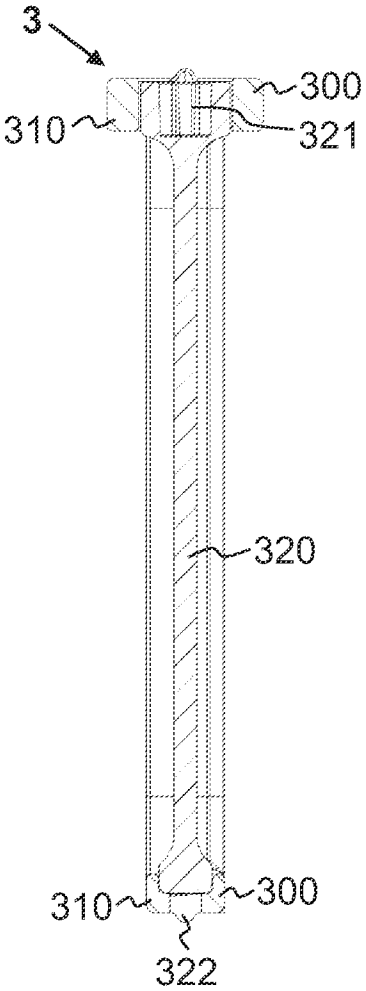
FIG. 12 shows a longitudinal section through the upper part as per FIG. 10.
Figure 11:
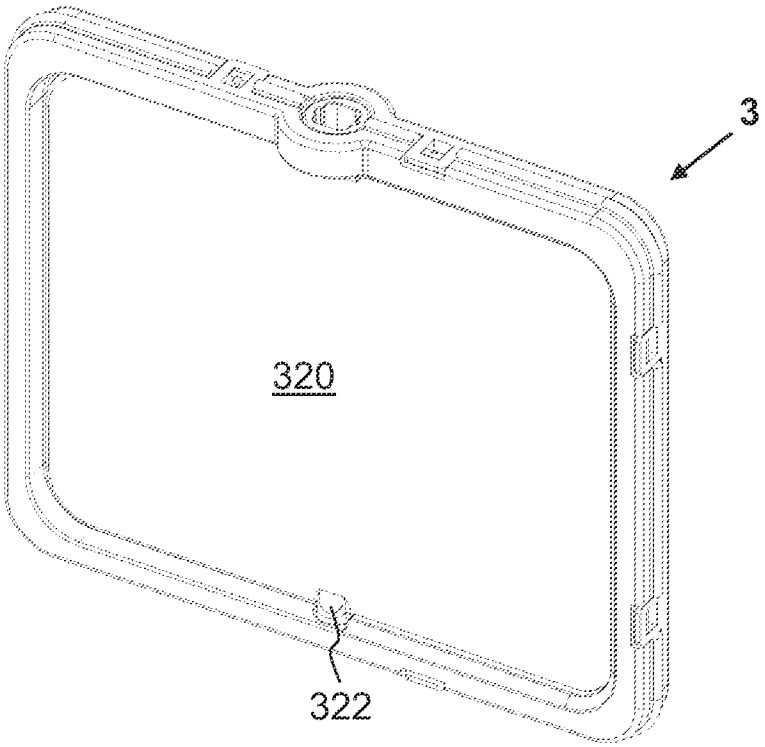
FIG. 11 shows a perspective view of the lower part as per FIG. 10.

The first flap unit 2 is illustrated in FIGS. 7 to 9. It comprises three components: a right-hand frame part 20, a left-hand frame part 21 and a first flap element 22 which is arranged pivotably therein.

The two frame parts 20, 21 have in each case one upper surface 200, 210 and upwardly projecting side walls 201, 211 with inwardly directed retaining noses 202, 212 for receiving and fixing the motor 10.

The two frame parts 20, 21 have at the top and bottom in each case one semicircular recess 206, 216 which, in the put-together state of the first flap unit 2, form circular openings and which serve for receiving the shaft portions 221, 222 and a second end part 322.

The two frame parts 20, 21, preferably by means of snap-action connections, can be joined together to form a common frame and fixed. For this purpose, provision is made for example of latching-in clips 203, 213 and associated latching-in hooks 204, 214. The side surfaces 205, 215 preferably have a triangular cross section, wherein they narrow downward, that is to say away from the motor 10.

The first flap element 22 is preferably formed in one piece. It has the plate-shaped first flap 220, on which is formed centrally at the upper end the upper shaft portion 221 and centrally at the lower end the lower shaft portion 222. The lower shaft portion 222 ends in a first end part 223 which is of polygonal form.

The first flap 220 and/or the first frame 20, 21 are/is preferably designed in such a way that the tightest possible closure thereof is realized. Said flap is held in a rotatable or pivotable manner in the frame 20, 21.

As can be clearly seen in FIGS. 8 and 9, the upper shaft portion 221 passes through the upper region of the frame 20, 21 and the lower shaft portion 223 passes through the lower region. Both protrude beyond the frame 20, 21 in order that they can be connected to the motor 10 or to the rotary plate 12 and to the second flap unit 3.

The second flap unit 3 likewise has a right-hand and a left-hand frame part 30, 31 with a second flap element 32 held therebetween. The two frame parts 30, 31 have in each case one rectangular frame 300, 310 whose walls are of relatively narrow form. Said two frames 300, 310, preferably by means of snap-action connections, can be connected and fixed. Provision is made of corresponding latching-in clips 303, 313 and latching-in hooks 304, 314. The frames 300, 310 have semicircular recesses 306, 316 which are arranged centrally at the top and which, in the put-together state of the frame 30, 31, form a common circular leadthrough opening for receiving a shaft bearing 321. The frames 300, 310 moreover have semicircular recesses 306, 316 which are arranged centrally at the bottom and which, in the put-together state of the frame 30, 31, form a common circular receiving opening for receiving a second end part 322.

The second flap element 32 is preferably likewise formed in one piece. It has the plate-shaped second flap 320, on which is formed centrally at the upper end the shaft bearing 321, which is of internally polygonal form. The shaft bearing 321 serves for rotationally conjoint connection to the first end part 223 of the lower shaft portion 222. Formed centrally on the lower end of the second flap 320 is the second end part 322, which serves for rotatable or pivotable mounting of the second flap 320 in the lower receiving opening 316 of the second frame 30, 31.

The second flap 320 and/or the second frame 30, 31 are/is likewise preferably designed in such a way that the tightest possible closure thereof is realized. Said flap is held in a rotatable or pivotable manner in the second frame 30, 31.

The individual elements of the closure element M are preferably manufactured from metal or from plastic. They are inexpensive to manufacture and simple to put together. Moreover, owing to the two frames, the installation into the ventilation device is simplified.

Figure 14:
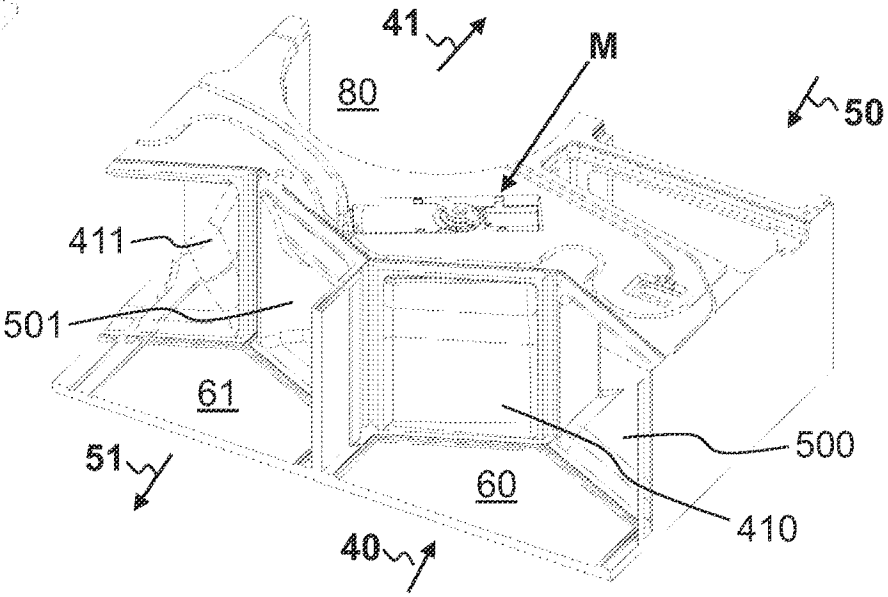
FIG. 14 shows a second perspective view of the part as per FIG. 13.
Figure 13:
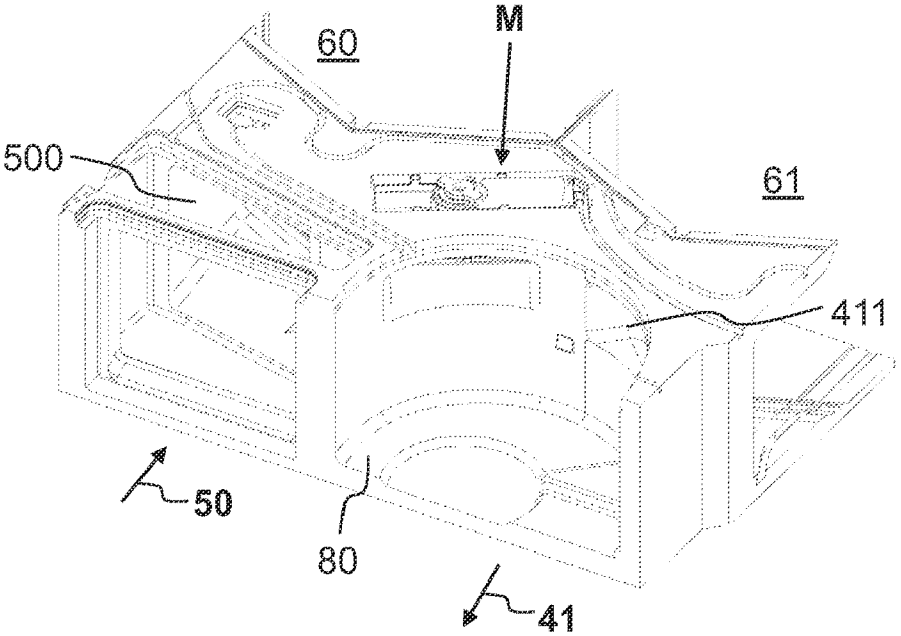
FIG. 13 shows a first perspective view of the ventilation apparatus according to the invention.

FIGS. 13 and 14 shows a detail of a ventilation apparatus with integrated closure unit according to the invention. The sub-channels are provided with the same reference signs as in the example described above.

In the examples described in the present text, the supply-air channel may also be the expulsion-air channel and the outside-air channel may also be the exhaust-air channel. The text is to be understood in a corresponding manner. The same applies to the sub-channels.

The closure unit according to the invention, in the case of which two flaps are actuated together, makes it possible for two heat exchangers operated in parallel to be used without a further bypass channel.

The invention claimed is:

1. A closure unit of a ventilation apparatus, wherein the closure unit has at least two pivotably arranged flaps for closing off in each case one ventilation channel, wherein the two flaps are movable by means of a common shaft which defines a pivot axis, wherein the closure unit has a first frame for pivotably receiving a first flap and has a second frame for pivotably receiving a second flap, wherein the shaft has an upper portion which is pivotably mounted in the first frame and which is connected at a first end to the first flap and at a second end to the motor, and wherein the shaft has a lower portion which is connected at a first end to the first flap and at a second end to the second flap, wherein the second flap and/or the second end of the lower portion of the shaft are/is pivotably mounted in the second frame.

2. The closure unit as claimed in claim 1, wherein the pivot axis extends centrally through the two flaps.

3. The closure unit as claimed in claim 1, wherein the common shaft is driven by a motor which, in the longitudinal direction of the shaft, is arranged above or below the two flaps or centrally between the two flaps.

4. The closure unit as claimed in claim 1, wherein the two flaps are arranged at an angle of 90° or of 0° to one another.

5. The closure unit as claimed in claim 1, wherein each of the two flaps forms a closure surface, and wherein the two closure surfaces contain the pivot axis of the shaft.

6. The closure unit as claimed in claim 1, wherein the two flaps have a rectangular cross section.

7. The closure unit as claimed in claim 1, wherein said closure unit is a structural unit in the form of a closure module.

8. The closure unit as claimed in claim 1, wherein the ventilation apparatus is a ventilation apparatus with heat recovery.

* * * * *